United States Patent [19]

Ish, III et al.

[11] Patent Number: 4,900,018

[45] Date of Patent: Feb. 13, 1990

[54] EXERCISE MACHINE WITH MULTIPLE EXERCISE STATIONS

[76] Inventors: Arthur B. Ish, III, 17526 NE. 88th Pl.; Jeffrey B. Johnson, 9301 Avondale Rd. NE., #M1069, both of Redmond, Wash. 98052

[21] Appl. No.: 245,684

[22] Filed: Sep. 16, 1988

Related U.S. Application Data

[63] Continuation-in-part of Ser. No. 97,549, Sep. 16, 1987, Pat. No. 4,809,972.

[51] Int. Cl.[4] ..... A63B 21/00

[52] U.S. Cl. ..... 272/134; 272/118; 272/143

[58] Field of Search ..... 272/117, 118, 123, 125, 272/134, 136, 142, 143, 144; 24/568, 652, 662, 666, 667, 683; 2/304, 305, 307, 340, 341, 342, 230, 323

[56] References Cited

U.S. PATENT DOCUMENTS

| | | | |
|---|---|---|---|
| 520,723 | 5/1894 | Bloomberg | 24/667 X |
| 970,931 | 9/1910 | Kramer | 24/667 |
| 1,832,407 | 11/1931 | Mix | 24/662 X |
| 4,272,072 | 6/1981 | Kusmer | 272/143 X |
| 4,505,475 | 3/1985 | Olschansky et al. | 272/134 X |
| 4,509,746 | 4/1985 | Mask | 272/134 |
| 4,634,127 | 1/1987 | Rockwell | 272/134 |
| 4,697,809 | 10/1987 | Rockwell | 272/118 |

FOREIGN PATENT DOCUMENTS

| | | | |
|---|---|---|---|
| 3326426 | 1/1985 | Fed. Rep. of Germany | 272/118 |
| 2158362 | 11/1985 | United Kingdom | 272/134 |

*Primary Examiner*—Richard J. Apley
*Assistant Examiner*—Robert W. Bahr
*Attorney, Agent, or Firm*—Seed and Berry

[57] ABSTRACT

An exercise machine has multiple stations at each of which two or more exercises are performed in opposition to a selected amount of weight in a weight stack. A cable and pulley system connects the exercise apparatus at the exercise stations with the weight stack in such a manner that only one pull cable in the system is connected to the weight stack.

11 Claims, 4 Drawing Sheets

EXERCISE MACHINE WITH MULTIPLE EXERCISE STATIONS

TECHNICAL FIELD

The present invention relates to exercise machines of the type having multiple exercise units which operate in opposition to a single set of weights. This application is a continuation-in-part of pending application Ser. No. 097,549, filed Sept. 16, 1987 now U.S. Pat. No. 4,809,972.

BACKGROUND ART

A variety of exercise units have been used in exercise centers for many years each having a set of weights lifted responsive to manual force exerted for muscular development. The exerciser can normally vary the amount of weight resisting the exercising effort. As the need for compact exercise equipment has developed for use, for example, in residences, attempts have been made to provide arrangements in which multiple exercise units operate on a single set of weights rather than providing an individual set of weights for each exercise unit. One approach has been an arrangement in which each exercise unit had to be connected to the weight set whenever it was to be used and then disconnected when another of the exercise units was to be used. Another approach has been to connect to the single set of weights by a respective cable for each exercise unit in such a manner that each of these cables is only tensioned when the respective exercise unit is used. This usually results in an arrangement in which the pull line of the cables when tensioned is off center relative to the center of gravity of the weight set.

With the foregoing shortcomings in mind, the present invention aims to provide a simplified arrangement in which multiple exercise units are continuously connected to a single weight set by a pulley and cable system which only attaches to the weight set by a single centered cable.

DISCLOSURE OF THE INVENTION

In carrying out the invention, multiple exercise stations are provided, each preferably incorporating more than one exercise unit. Each exercise unit is connected to one of multiple cables each of which is tensioned when one of the exercise units is used. The cable connected to the weight set has an exercise unit at its opposite end and passes over sets of floating pulleys through which are reeved other cables each having exercise units at its ends. Each cable end has a stop to prevent retracting of the cable so that each cable in the system can be tensioned responsive to use of one of the exercise units. Additional exercise units can be incorporated by use of single floating pulleys on one of the cables which are directly connected to an exercise unit. In some instances, instead of connecting the end of a cable directly to an exercise unit, it can be connected to a pulley which in turn has a secondary cable reeved thereon and connected at its ends to an exercise unit as, for example, a butterfly exercise unit having its wings connected to the ends of the secondary cable.

In the preferred embodiment, three exercise stations are arranged in a generally triangular configuration, with the weight set on a base platform therebetween. Each station has two exercise units. A hollow column houses part of the cable and pulley system and provides a reach arm overlying the weight unit and a second reach arm overlying one of the exercise stations. A first cable connects to the weight set and is guided over the first reach arm into the column where it is reeved through two sets of floating pulleys and then is guided to the outer end of the second reach arm to connect to one of the exercise units. Two other cables are reeved in the column through the respective of the two floating pulley sets and are guided out of the column to the exercise stations. A fourth cable passes over a single floating pulley in the column and connects at its ends to one of the exercise units.

BEST MODE FOR CARRYING OUT THE INVENTION

Figure 1:
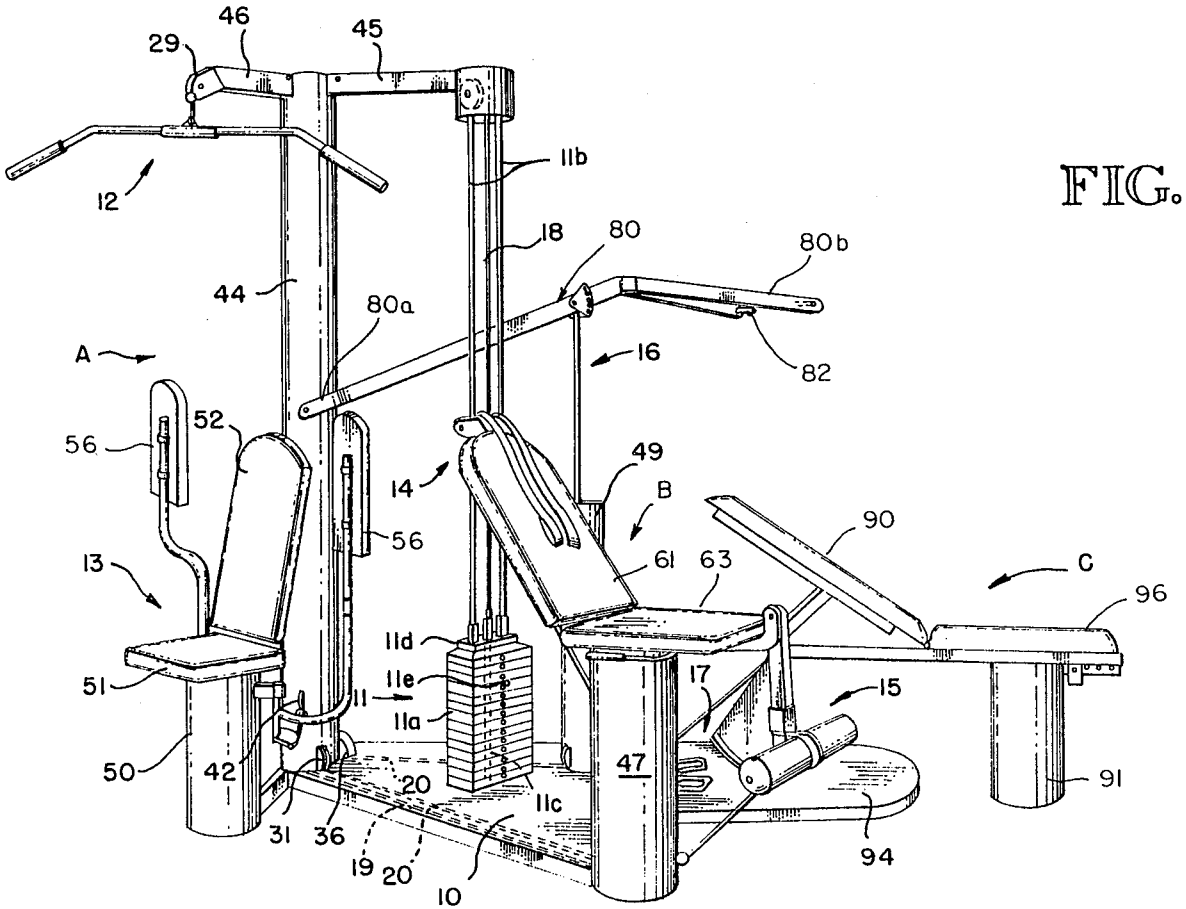
FIG. 1 is a perspective view of an exercise machine embodying the present invention.

Referring to the drawings, the exercise machine of the present invention has three exercise stations A, B and C at the apexes of a generally triangular base frame 10. Each exercise station has two exercise units individually operative to lift weights in a weight stack unit 11 resting on the base frame. For ease of explanation, the exercise unit 12–13 at station A are designated the "high pull unit" and the "butterfly unit," the exercise units 14–15 at station B are designated the "abdominal crunch unit" and the "leg curl/extension unit," and the exercise units 16–17 are designated the "press unit" and the "low pull unit."

The weight stack unit 11 is of standard construction, comprising a stack of rectangular weights 11*a* which are slide-mounted on a pair of vertical guide rods 11*b*, each weight having a central horizontal hole registering with a respective hole in a central pick-up rod 11*c*. This pick-up rod depends from a head plate 11*d* which is also slide-mounted on the rods 11*b* and has a lift cable 18 secured thereto. The amount of weight to be lifted is selected by engaging a lock pin 11*e* through the appropriate one of the weights 11*a* into the pick-up rod 11*c*. Hence, when the cable 18 is adequately tensioned, the selected number of weights in the stack is lifted.

Figure 2:
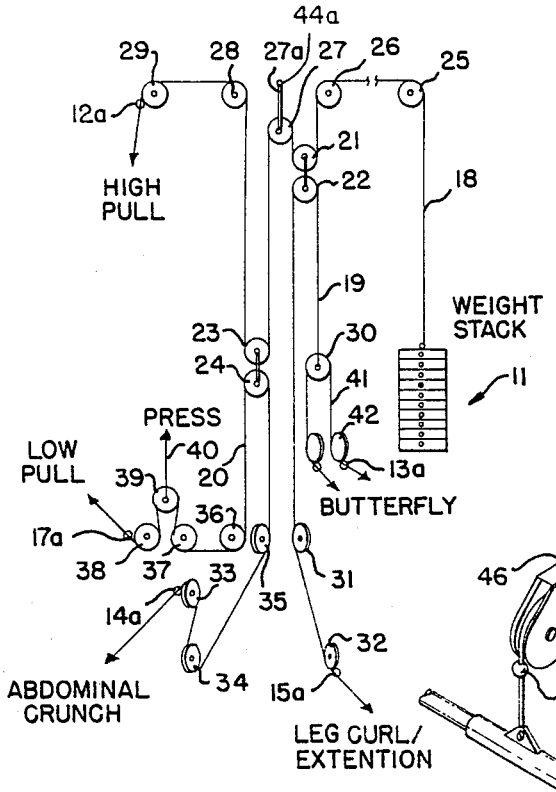
FIG. 2 is a schematic showing the cable and pulley system for the exercise machine.

As shown in FIG. 2, the cable 18 functions in conjunction with cables 19 and 20 by way of floating pulley sets 21–22 and 23–24, the two pulleys in each of these sets being coupled together. Cable 18 is guided by five guide pulleys 25–29 and passes beneath the floating pulley 21. The center pulley 27 is vertically adjustable for slack take-up. Cable 19 passes over floating pulley 22, is connected to a floating pulley 30, and is guided by guide pulleys 31–32. Cable 20 passes over floating pulley 24, is guided by six guide pulleys 33–38, and passes over a floating pulley 39 which is connected to the lower end of a cable component 40 of the press unit 16. Another cable 41 passes over the floating pulley 30 and is guided by guide pulleys 42–43.

The high pull unit 12 is connected to one end of the cable 18, the butterfly unit 13 is connected to the ends of cable 41, the leg curl extension unit 15 is connected to one end of the cable 19, and the abdominal crunch unit 14 and the low pull unit 17 are connected to the ends of cable 20. The cable component 40 and the cables 18, 19, 20 and 41, have ball-like stop fittings **16*a*, 12*a*, 13*a*, 14*a*, 15*a* and 17*a***, respectively mounted thereon to restrict retraction thereof.

With the described pulley and cable arrangement it can be seen that the tension in the three cables 18–20 is equal whenever one of them is tensioned by operation of an exercise unit, that the tension in the cable 41 is one-half the tension in the cables 18–20, and that the downward pull force on the cable component 40 of the press unit 16 is twice the tension in the cables 18–20.

Adjacent the butterfly unit 13 and at one apex of the base 10 there is mounted a column 44 having two reach arms 45, 46 mounted at its upper end. Reach arm 45 projects above the weight stack 11 and is connected to the upper end of the guide rods **11*b*. The guide pulleys 25, 26 are mounted at the outer and inner ends of the reach arm 45, and the guide pulleys 28, 29 are mounted at the inner and outer ends of the reach arm 46. Slack adjusting pulley 27 is mounted on the lower end of a threaded rod 27*a* passing downwardly through a top bracket 44*a* on the column 44** and having an adjusting nut above the bracket.

The sets 21–22 and 23–24 of floating pulleys and the floating pulley 30 float within the column 44, and the guide pulleys 42–43 for the cable 41 are mounted between two pairs of cheeks projecting from the sides of openings in the column spaced above the lower end thereof and facing the butterfly unit 13. At its lower end, the column 44 has internal supports for the guide pulleys 31, 35. These pulleys are in staggered relationship and guide the cables 19, 20 through openings in the column 44 toward station B. The column 44 has a third pair of cheeks projecting near the lower end thereof from the sides of an opening to receive the guide pulley 36, which is arranged to guide the cable 20 toward station C.

At station B, a cylindrical pedestal 47 is mounted on the base frame 10 and has the pulleys 32 and 34 mounted in its lower end with adjacent openings for the cables 19, 20. Another pedestal 49 is mounted on the base frame 10 for housing the floating pulley 39 below the press unit 16. The guide pulleys 37, 38 are mounted at the lower end of the pedestal 49 at openings for entry of the cable 20 and exit thereof to make connection to the low pull unit 17 after passing over the floating pulley 39, which floats within the pedestal 49 and is connected to the cable component 40 of the press unit 16.

Figure 3:
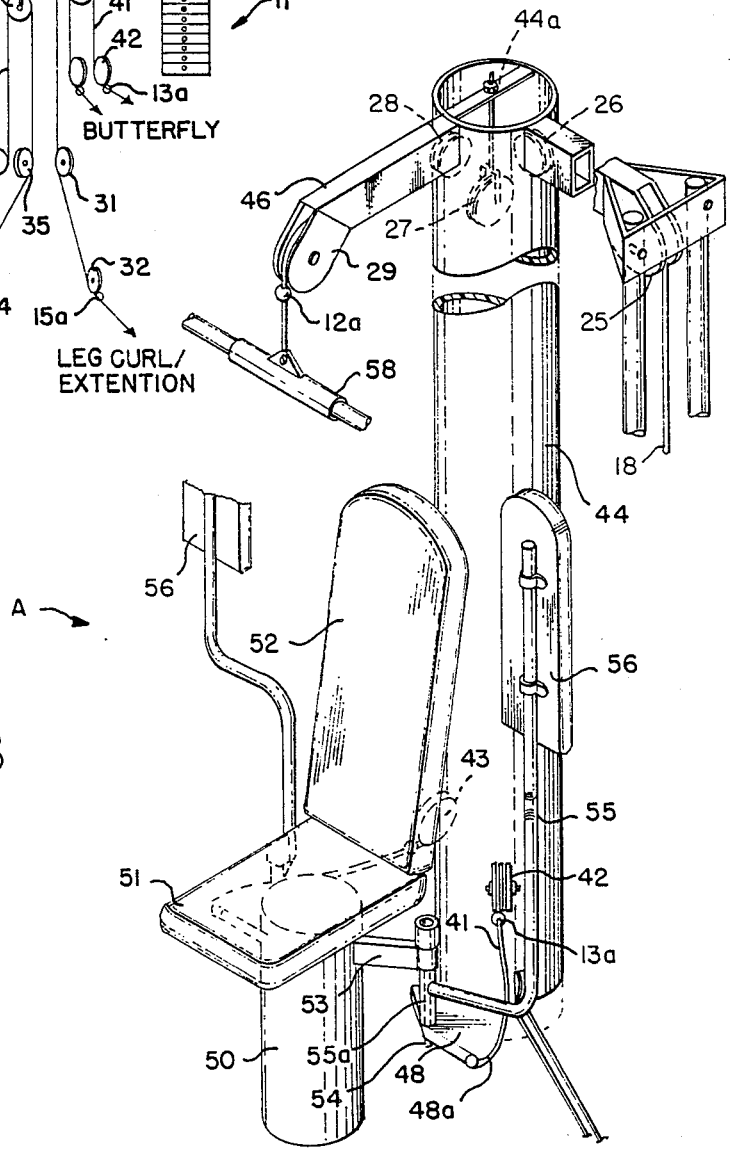
FIG. 3 is a perspective view of one of the exercise station which incorporates a high pull exercise unit and a butterfly exercise unit.

Directing attention to the butterfly unit 13 (FIG. 3), the ends of the cable 41 pass out of the column 44 beneath the guide pulleys 42–43 and are anchored at the front of a pair of generally horizontal cam members 48 which are located at opposite sides of a pedestal 50 for a seat 51 having an upstanding back rest 52. The pedestal 50 and back rest 52 are rigidly connected to the column 44 by suitable rear braces. A pair of brackets 53 project laterally from opposite sides of the pedestal 50, and each supports a depending pivot pin 54 on which a sleeve **55*a* is journal-mounted which is connected to a swinging support rod 55 of generally Z-shape for a respective padded wing 56. At its lower end, each sleeve 55*a* is secured to a respective one of the cams 48. The pivot pins 54 extend downwardly beyond the sleeves 55a to receive cotter keys therethrough for retaining the wings 56 and related apparatus. The stops 13*a* are fixed on the cable 41 so that they will engage the column 44 at the exit openings for the cable 41 from the column 44 at the pulleys 42–43 and leave slack in the portions of the cable 41 between the stops 13*a* and the cams 48 when the wings 56 are swung rearwardly toward the column 44 sufficiently to be out of the way of an exerciser seated on the seat 51 and pulling down on the overhead handlebar 58 of the exercise unit 12, in opposition to the selected number of weights in the weight stack 11**.

When an exerciser desires to perform the butterfly exercise after seating on the seat 51, the exerciser swings the wings 56 forwardly taking out the slack in the outer end portions of the cable 41, and then swings the wings 56 forwardly by pressure of the forearms applied at the back of the wings. This forward swinging motion tensions the cable 41 over the outer surface of curved convex cams **48*e* at the back of the cam members 48 as they rotate with the wings 56 about the axis of the pivot pins 54 in opposition to the selected number of weights in the weight stack 11. It is noteworthy that the described arrangement makes it possible for the seat 51 to be used for both the butterfly unit 13 and high pull unit 12** without the movable components of either unit being in the way of the exerciser when not in use.

Figure 6:
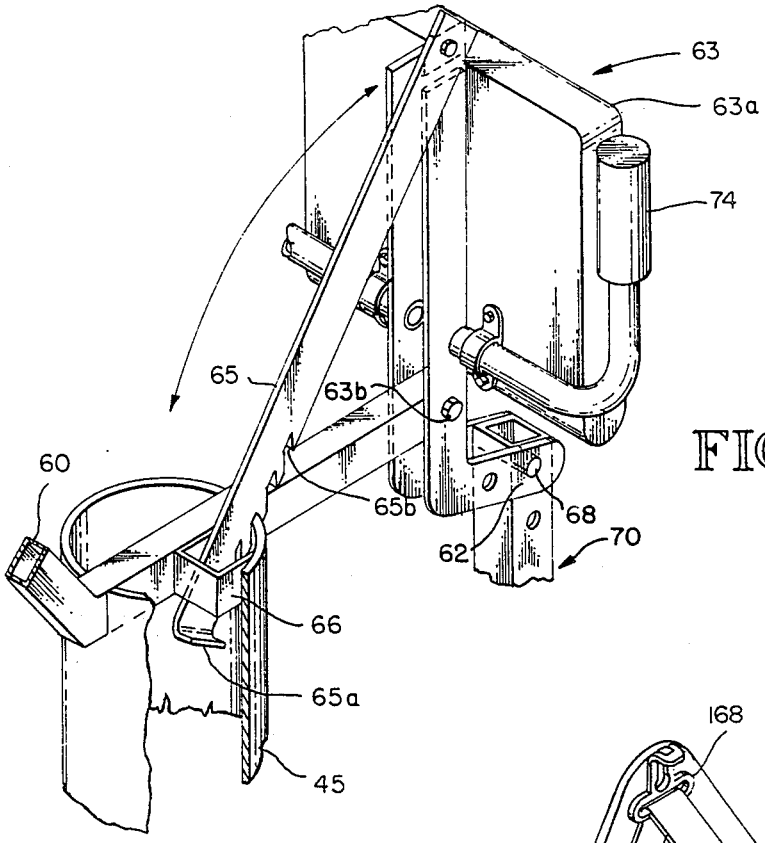
FIG. 6 is a fragmentary perspective view of the second exercise station showing the seat raised to the position for performing the leg curl/extension exercise.

Continuing to station B (FIGS. 4 and 6), the pedestal 47 rigidly supports a rearwardly sloped back support member 60 to which is connected a padded back rest 61. The member 60 continues horizontally at its lower end over the top of the pedestal 47 and is straddled by the frame 62 of a seat assembly 63. The frame 62 extends upwardly forwardly of the seat to provide a pivot support **62*a*. The seat assembly has a padded seat 63*a* and is pivoted at 63*b* so that it can swing upwardly to a generally vertical position, as shown in FIG. 6, preparatory to performance of the leg curl exercise. The back support member 60 supports the pulley 33 at the top on a pulley bracket which is engaged by the stop ball 14*a* on the respective end of the cable 20 when the exercise unit 14 is idle. A yoke in the form of a pair of elongated strap loops 64 connected together at the top, is connected to the end of the cable 20** to function as part of the apparatus for the abdominal crunch exercise.

Pivoted at an upper end to the back of the seat 63 is a link 65 which has its lower end bent at right angles to the rest of the link to provide a stop **65*a* for cooperating with the underside of a U-shaped bracket 66 mounted on the inside of the seat pedestal 47. The link 60 extends through the bracket 66 and is formed with a notch 65*b* to serve as a catch for fitting onto the upper end of the seat pedestal 47 when the seat assembly 63 is swung upwardly so that the seat assembly 63 cannot then swing down from the upright position without the link 65 being lifted free of the seat pedestal 47** preparatory to swinging the seat back to a horizontal seating position.

A dual-purpose element 70 of inverted T-shape having padded bottom arms 70*a* is pivotally suspended at 68 from the pivot support 62*a*. The cable 19 passes from the guide pulley 32 in the seat pedestal 45 forwardly through a front opening in the pedestal and connects to the lower end of the dual-purpose element 70. The stop ball 15*a* is fixed on the cable 19 to engage the outer face of the pedestal when the dual-purpose element 70 is in a down position and a releasable lock pin 72 passes through the pivot support 62 and upper end of the dual-purpose element 70 so that the latter can be selectively held in a fixed down position or be free to be swung forwardly away from the seat pedestal 47. It will be noted that the seat assembly 63 also has a pair of side handles 74 which are laterally offset from the seat 63*a* and are positioned so that they may be conveniently grasped by a rearwardly facing exerciser when the seat occupies its horizontal or upright position.

Figure 4:
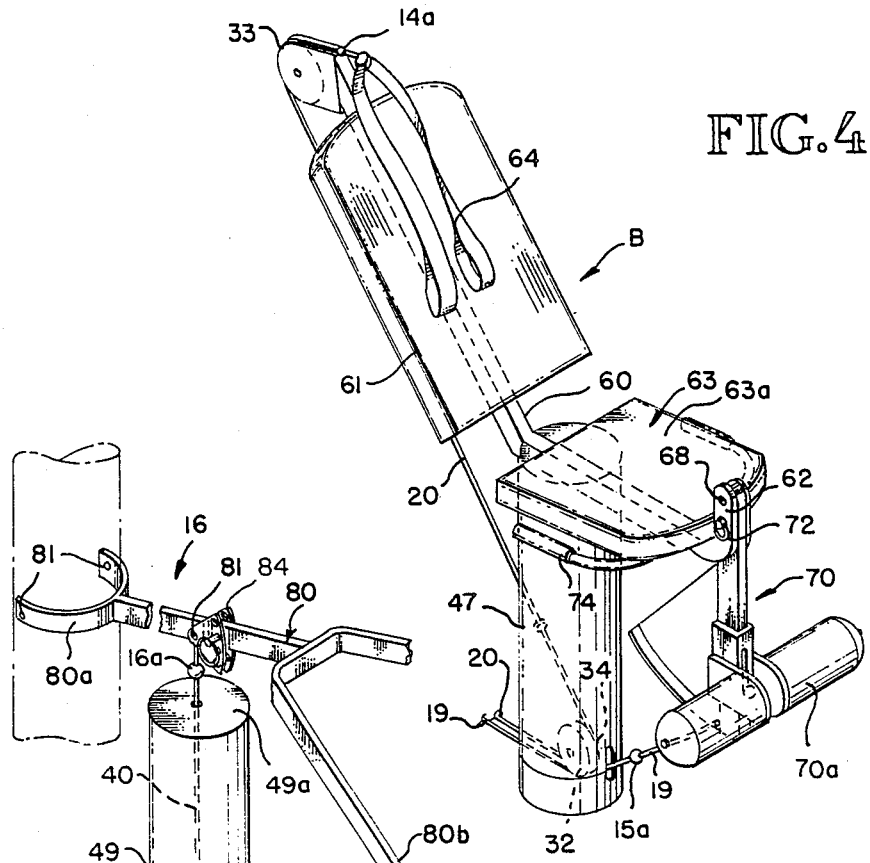
FIG. 4 is a respective view of the second exercise station which incorporates an abdominal crunch exercise unit and a leg curl/extension exercise unit, the station having its seat in the lowered position for performing the abdominal crunch exercise.

The abdominal crunch exercise is performed when the seat assembly 63 is in its horizontal position, as shown in FIG. 4, and the dual-purpose element 70 is locked against swinging movement by the pin 72. The exerciser seats on the seat 63*a*, rests his back against the back rest 61 with the loops 64 passing over his shoulders, and positions his legs so the front of his ankles bear against the back of the padded bottom arms 70*a*. Then the exerciser performs the abdominal crunch exercise by grasping the loops 64 and pulling them downwardly and outwardly away from the upper pulley 33 in opposition to the selected load at the weight stack while keeping his lower back against the back rest 61.

To perform the leg extension exercise, the exercise unlocks the dual-purpose element 70 by removing the pin 72 and then grasps the handles 74 while seated. Using both legs, the exerciser pivots his legs at the knee away from the seat pedestal 47, engaging the padded arms 70*a* and forcing element 70 to swing forwardly in opposition to the selected load at the weight stack 11.

Preparatory to performing the leg curl exercise, the seat assembly 63 is swung upwardly and locked in upright position by use of the link 65, and the lock pin 72 is released so that the dual-purpose element 70 is free to swing forwardly in opposition to the selected load at the weight stack 11. As the seat assembly 63 swings upwardly, the pivot 68 swings forwardly and lowers. In the raised position of the pivot 68, the arms 70*a* of the dual-purpose element 70 are at the most suitable height for the leg extension exercise; and when the pivot 68 is in its lowered position, the pivot 68 and arms 70 are in the most suitable position for the standing leg curl exercise. Preferably, the axis of pivot 68 coincides with the knee joint axis of a user. The exerciser faces rearwardly in standing position with his legs behind the padded bottom arms 70*a* and grasps the upright seat handles 74. Then the exerciser pivots one of his legs at the knee away from the seat pedestal 47 so that the back of the ankle of the leg engages the respective padded arm 70*a* and forces the dual-purpose element 70 to swing forwardly away from the seat pedestal 47 in opposition to the selected load at the weight stack 11. After swinging the leg back and forth the selected number of times, the exercise is repeated with the other leg.

Figure 7:
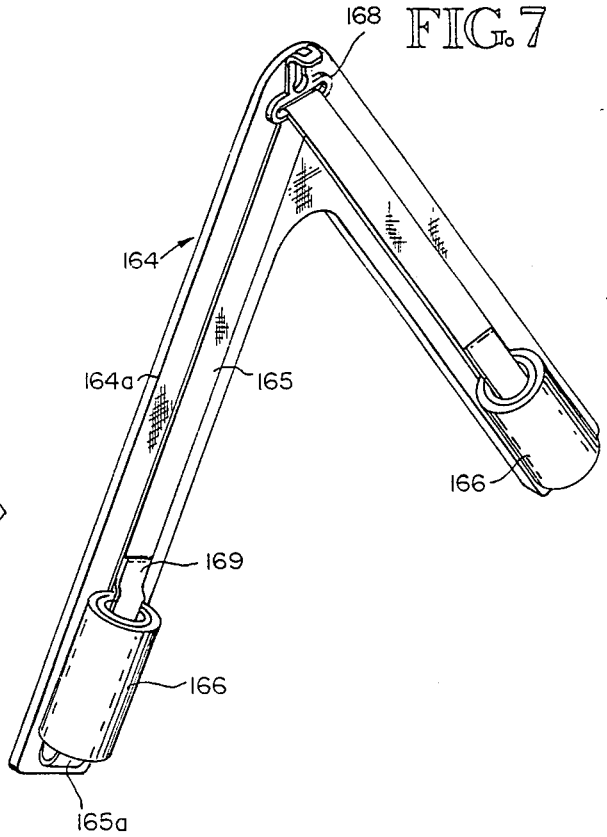
FIG. 7 is a perspective view of another embodiment of the yoke assembly used in the second exercise station shown in FIG. 4.
Figure 8:
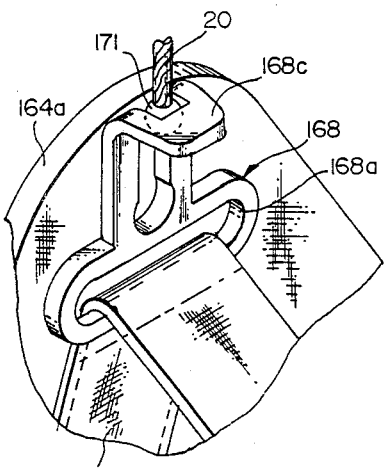
FIG. 8 is a detail view of the top portion of the yoke assembly shown in FIG. 7.

Referring to FIGS. 4, 7 and 8, the straps 64 in FIG. 4 may be provided by a modified padded assembly 164 having a fabric-covered, V-shaped, padded yoke unit 164*a* onto which a continuous strap 165 is mounted by stitching 167 along its longitudinal edge portions. End portions of the strap 165 are doubled over to form loops 165*a* which pass axially through padded cylindrical hand grips 166. The terminal ends of the strap 165 are then stitched at 169 to intermediate portions of the strap 165 and the pad unit 164*a*.

The center of the strap 165 passes through a linear slot 168*a* provided by a generally T-shaped rigid fitting 168. This fitting also has a keyhole slot 168*b* extending at right angles to the length of the linear slot 168*a*. The eye of the keyhole slot 168*b* is adjacent the linear slot 168*a*. At the other end of the keyhole slot the fitting 168 is bent away from the pad unit 164*a* as a hook portion 168*c*.

The strap 165 passes diagonally under the lower end of the fitting 168 and forwardly through the linear slot 168*a* on a diagonal. Stitching 170 directly beneath the fitting 168 further anchors it in position as shown.

A terminal ball 171 fixed on the cable 20 is fitted through the eye of the keyhole slot 168*b* from between the pad unit 164*a* and the back of the fitting 168. Then the assembly 164 is pulled downwardly to tension the cable so that the ball 170 occupies the top of the keyhole slot 168*b* and bears against the underside of the hook portion 168*c*. The above-described terminal ball 171 and fitting 168 assembly are also used at other cable terminals on other stations of the exercise apparatus. On the high pull unit 12, a safety tab blocks the keyhole slot 168*b* to prevent the cable from becoming inadvertently detached from the high pull unit. With the described arrangement, the exercising person places the yoke over his(her) neck and grabs the handgrips 166. The load is carried directly from the strap 165 to the cable 20 via the fitting 168 and the ball 171.

Figure 5:
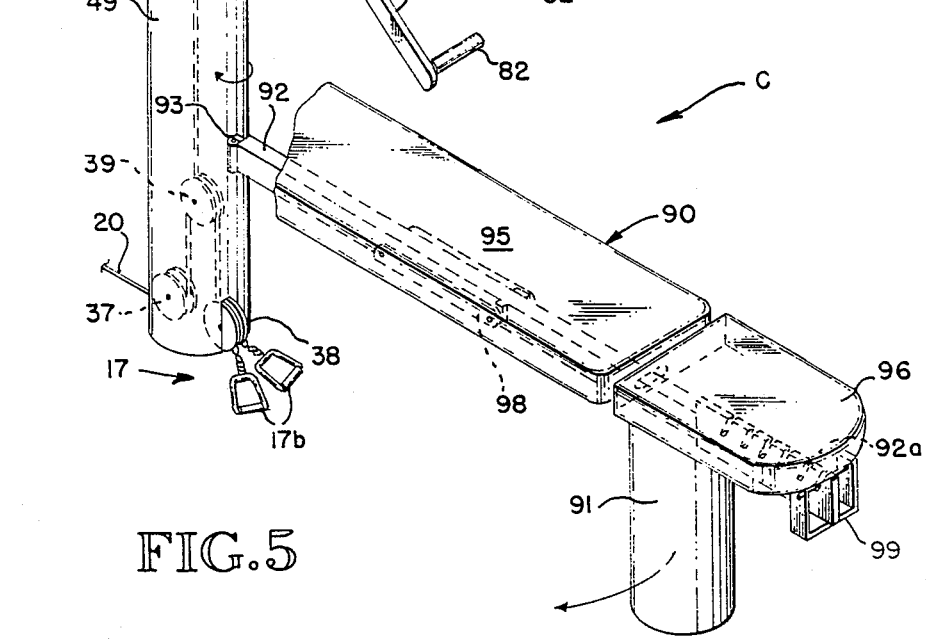
FIG. 5 is a perspective view of the third exercise station which incorporates the press exercise unit and low pull exercise unit.

Continuing to station C, the cable 20 passes forwardly from the guide pulley 38 (FIG. 5), through a front opening in the pedestal 49 and is connected, for example, to a pair of hand grips 17*b* for performing a low pull exercise. The pulley 38 is preferably mounted for swinging movement of about thirty degrees on a vertical axis. The stop 17*a* on the cable 20 is arranged to engage a stop bracket at the underside of the pulley 38 to restrict retraction of the cable.

As previously indicated, the cable component 40 is connected to the floating pulley 39 within the pedestal 49. It extends upwardly through a center opening in a head plate 49*a* at the top of the pedestal 49 and has the stop 16*a* arranged to engage the upper surface of the head plate 49*a* when the press unit 16 is not in use. The cable component 40 is connected at its upper end to a swing bar 80 having a forked rear end portion 80*a* which straddles the column 44 and is pivotally connected thereto at 81. The forward end of the swing bar 80 has rigid fork extensions 80*b* which are bridged at their forward ends by a handle bar 82. It is preferred that the cable component 40 be connected to the swing bar 80 approximately midway between the pivot 81 and the handlebar 82 so that the exerciser has a 2:1 mechanical advantage when he pushes up on the handle bar 82 in opposition to the load of the selected weights in the weight stack 11 in performing the press exercise. This 2:1 mechanical advantage, by doubling the upward force exerted on the pulley 39 for a given manual upward force exerted on the handle bar 82, results in substantially the same tension in the cables 18–20 as results when the same manual force is applied to the cables 18–20 at any one of the other exercise units. The function of stop 16*a* can be performed by having the handle 80 rest directly on the pedestal 49.

To provide adjustment of the height of the handle bar 82 during performance of the press exercise, the swing bar 80 is articulated forwardly of the cable component 40 to provide rear and forward swing bar sections 80*a*, 80*b*. The rear section 80*a* has a sector plate 84 forwardly of the articulation. This plate has an arcuate row of holes for selectively receiving a pin registering with a hole through the front section 80*b*.

For body support while performing the press exercise, a bench assembly 90 is provided at station C which comprises a pedestal 91 supporting the forward end portion of a bench frame 92. At its rear end the bench frame 92 is pivotally mounted at 93 to the pedestal 49 for horizontal swinging movement so that the bench assembly can be swung laterally out of the way when optional exercises are to be performed using exercise unit 16 or a low pull exercise is to be performed using grips 17*b*. In this regard, a resilient floor mat 94 connected to pedestal 49 may be provided for stability when performing low pull exercises with exercise unit 17 or press exercises with exercise unit 16 without use of the bench 90.

The bench assembly has padded adjustable back rest and seat rest sections 95–96 swingably connected together. The back rest section 95 has a pair of pivoted links 98 pivotally connected to the frame 92 and the seat section 96 is slidable along the frame 92 for adjusting the slope of the back rest section. Notches 92*a* in the frame 92 are selectively engaged by a slide element 99 on the seat section 96 to hold it in the horizontal position corresponding to the desired slope, if any, for the back section 95.

It will be apparent that additional exercise stations can be added incorporating the cable and pulley system concepts of the invention. It is also apparent that sprockets and chains can be substituted for the pulleys and cables of the system; hence, it is intended that "pulley" and "cable" when used in the claims be interpreted to include sprockets and chains or belts.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. An exercise machine having an exercise station comprising:

a pedestal;

a back rest and a seat mounted on said pedestal;

a pair of handles at opposite sides of said seat and arranged to swing forwardly to an upright active position from a retracted position;

a dual-purpose unit of generally inverted T-shape swingably hanging adjacent the front of said seat for forward swinging movement from a lowered position;

locking means for selectively locking said handles in their said active position and said dual-purpose unit in its said lowered position;

a load;

an exercise element positioned adjacent the top of said back rest;

a cable and pulley system connected to said load and including a first cable end located adjacent the top of said back rest and connected to said exercise element, and including a second cable end connected to said dual-purpose unit, whereby pulling on said exercise element is yieldingly resisted by said load via said first cable and whereby forward swinging movement of the dual-purpose unit is yieldingly resisted by said load via said second cable when said dual-purpose unit is not locked.

2. An exercise machine according to claim 1 in which said handles are connected to said seat and said seat is swing-mounted at its forward end to swing upwardly to an upright position from a lowered generally horizontal position.

3. An exercise machine according to claim 1 in which said load is a weight arranged to be lifted by said cable and pulley system responsive to independent operation of said exercise element and forward swinging movement of said dual-purpose unit.

4. An exercise machine according to claim 1 in which said exercise element comprises a flexible yoke connected to said first cable end, said yoke presenting a pair of handgrips.

5. An exercise machine according to claim 1 in which said dual-purpose unit has a swing axis located above the level of the top of said pedestal and said second cable end is connected to said dual-purpose unit below said swing axis.

6. An exercise machine according to claim 2 in which said dual-purpose unit is spaced forwardly from said pedestal and has a swing axis located adjacent the forward end of said seat.

7. An exercise machine according to claim 1 in which said exercise machine has another exercise station with two exercise units therein connected to said cable and pulley system when in use and when idle, and in which said load is a weight arranged to be lifted by independent operation of said two exercise units, said exercise element, and said dual-purpose unit via said cable and pulley system.

8. An exercise unit according to claim 1 in which said exercise element comprises a flexible yoke having a central fitting with a keyhole slot having an eye portion, said first cable extending through said keyhole slot and having a terminal ball engaging said fitting, said ball being of a size to pass through said eye portion and not through the remainder of said slot, said yoke also having a pair of handle grips remote from said fitting.

9. An exercise unit according to claim 8 in which said yoke has a second slot and a strap passing through said second slot and connected to said handle grips.

10. A yoke assembly for connecting to a cable having a terminal ball and located on an exercise machine, said yoke assembly comprising:

a flexible padded yoke element;

a central fitting with a keyhole slot having an eye portion for receiving such a ball of a size to pass through said eye portion and not through the remainder of said slot, said central fitting also having a second slot;

a pair of handle grips remote from said fitting; and a strap passing through said second slot and connected along a major part of its length to said padded yoke element, said strap having a pair of loops at its opposite ends which interfit with said handle grips.

11. A yoke assembly according to claim 10 in which said flexible padded yoke element has sufficient rigidity to maintain the handle grips at a desired separation distance.

* * * * *